US008626385B2

(12) United States Patent
Humphrey

(10) Patent No.: US 8,626,385 B2
(45) Date of Patent: Jan. 7, 2014

(54) SYSTEMS AND METHODS FOR ANALYZING MACHINE PERFORMANCE

(75) Inventor: James Decker Humphrey, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 114 days.

(21) Appl. No.: 13/421,057

(22) Filed: Mar. 15, 2012

(65) Prior Publication Data

US 2013/0245883 A1 Sep. 19, 2013

(51) Int. Cl.
*G06F 7/00* (2006.01)

(52) U.S. Cl.
USPC ..... 701/36; 701/33.7

(58) Field of Classification Search
USPC ..... 701/36, 33.7, 70; 307/10.1; 73/121; 340/453
See application file for complete search history.

(56) References Cited

U.S. PATENT DOCUMENTS 5,299,452 A * 4/1994 Caron et al. ..... 73/129
5,744,707 A 4/1998 Kull
6,332,354 B1 12/2001 Lalor et al.
6,405,117 B1 * 6/2002 Walenty et al. ..... 701/70
2003/0137194 A1 7/2003 White et al.
2005/0065677 A1 3/2005 Leblanc et al.

FOREIGN PATENT DOCUMENTS

JP 2008222084 9/2008
KR 100336335 5/2002
KR 1020030091325 12/2003

* cited by examiner

*Primary Examiner* — Marthe Marc-Coleman
(74) *Attorney, Agent, or Firm* — Finnegan, Henderson, Farabow, Garrett & Dunner LLP

(57) ABSTRACT

A system for analyzing machine performance is disclosed. The system may have one or more processors and a memory. The memory may store instructions that, when executed, enable the one or more processors to identify an event for a machine that includes a desired output parameter value and send a command to a component of the machine. A command value associated with the command may be determined based on the desired output parameter value, one or more machine state parameter values, and a feedback control loop. The instructions may further enable the one or more processors to determine whether the machine requires maintenance by comparing the command value to one or more historical command values each determined based on a historical desired output parameter value and one or more historical machine state parameter values.

20 Claims, 5 Drawing Sheets

SYSTEMS AND METHODS FOR ANALYZING MACHINE PERFORMANCE

TECHNICAL FIELD

The present disclosure relates generally to methods and systems for analyzing machine performance and more particularly, to methods and systems for determining machine maintenance schedules.

BACKGROUND

Machines, such as loaders, dozers, tractors, compactors, and other types of machines may perform a variety of tasks, e.g., digging, loosening, carrying, drilling, compacting, etc., different materials. Certain machines may be automated to perform one or more of these tasks, e.g., without direct human intervention. Organizations may desire to have an ability to forecast when components of such machines (whether autonomous or not) should be scheduled for maintenance. Moreover, the organization may desire to be able to schedule such maintenance prior to machine or component failure.

An exemplary system that may be used to determine maintenance schedules based on historical data is disclosed in U.S. Pat. No. 6,332,354 to Lalor et al. that issued on Dec. 25, 2001 (the '354 patent). The system in the '354 patent compares historical vehicle deceleration rates to current vehicle deceleration rates to assess current brake performance and determine brake maintenance schedules.

Although the system of the '354 patent may be useful for assessing brake performance by comparing deceleration rates, the system may not fully account for different command values corresponding to commands applied to the system. That is, the system in the '354 patent may merely compare deceleration rates for a particular set of conditions without comparing variable input commands being applied, e.g., based on feedback control systems, etc. Further, the system of the '354 patent may compare the current deceleration rates of a single vehicle to its own historical deceleration rates without considering how the vehicle compares to similar vehicles in similar situations.

The disclosed systems and methods for analyzing machine performance are directed to overcoming one or more of the problems set forth above and/or other problems of the prior art.

SUMMARY

In one aspect, the present disclosure is directed to a computer-implemented method for analyzing machine performance. The method may include identifying an event for a machine that includes a desired output parameter value, and sending a command to a component of the machine. The command may have a command value determined based on the desired output parameter value, one or more machine state parameter values, and a feedback control loop. The method may also include determining that the machine requires maintenance by comparing the command value to one or more historical command values each determined based on a historical desired output parameter value and one or more historical machine state parameter values. The historical desired output value and the one or more historical machine state parameter values may each correspond to the desired output parameter value and the one or more machine state parameter values.

In another aspect, the present disclosure is directed to a system for analyzing machine performance. The system may include one or more processors and a memory. The memory may store instructions that, when executed, enable the one or more processors to identify an event for a machine that includes a desired output parameter value and send a command to a component of the machine. The command may have a command value determined based on the desired output parameter value, one or more machine state parameter values, and a feedback control loop. The instructions may further enable the one or more processors to determine whether the machine requires maintenance by comparing the command value to one or more historical command values each determined based on a historical desired output parameter value and one or more historical machine state parameter values. The historical desired output value and the one or more historical machine state parameter values may each correspond to the desired output parameter value and the one or more machine state parameter values.

In yet another aspect, the present disclosure is directed to another computer-implemented method for analyzing machine performance. The method may include identifying an event including a desired output parameter value for a machine included in a plurality of machines. The method may also include receiving a command value of a command sent to a component of the machine. The command value may have been determined based on the desired output parameter value, one or more machine state parameter values, and a feedback control loop. The method may further include determining that the machine requires maintenance based on the command value and one or more other command values generated by one or more other machines of the plurality of machines during corresponding events for the one or more other machines. The corresponding events may also include the desired output parameter value.

DETAILED DESCRIPTION

Figure 1:
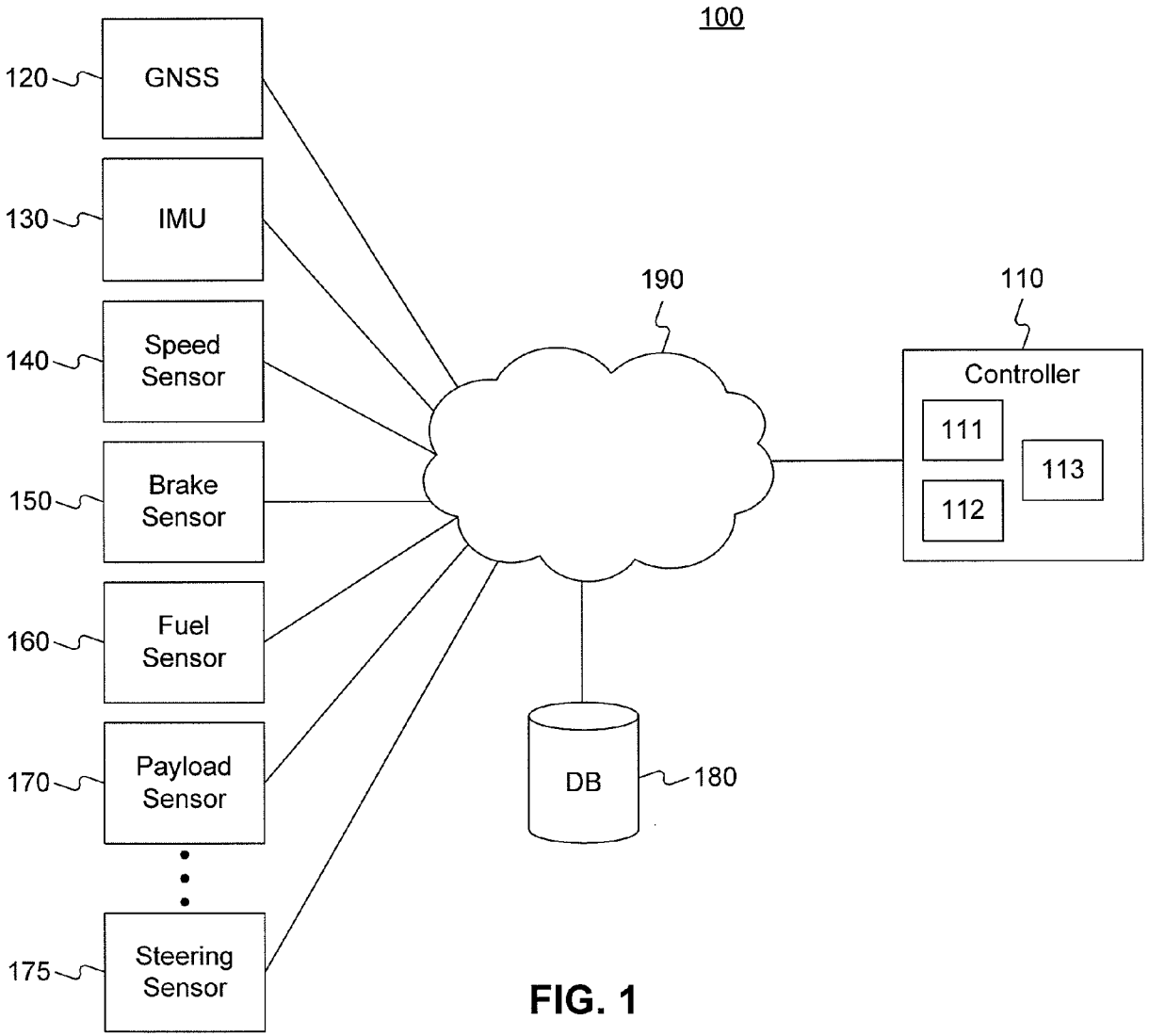
FIG. 1 is a diagrammatic illustration of an exemplary disclosed performance analysis system that may be incorporated into a machine.

FIG. 1 illustrates an exemplary performance analysis system 100 having a controller 110 connected via a network 190 to a global navigation satellite system (GNSS) device 120, an inertial measurement unit (IMU) 130, a speed sensor 140, a brake sensor 150, a fuel sensor 160, a payload sensor 170 (collectively referred to as sensors 120-170), and a database 180. One or more of the components of system 100 may be included on a machine (not shown) such as an autonomous or non-autonomous loader, dozer, tractor, compactor, etc. For example, one or more of controller 110 and sensors 120-170 may be located on the machine. In certain embodiments, the machine may include multiple instances of each sensor. For example, the machine may include more than one GNSS device 120, IMU 130, etc. Moreover, while sensors 120-170 are shown in FIG. 1, system 100 may include any other type of sensor consistent with disclosed embodiments.

As discussed in greater detail below, the components of system 100 may function together to analyze the performance of the machine and determine, e.g., based on a comparison of current machine performance to historical machine performance, whether and/or when the machine may require maintenance. For example, system 100 may analyze the performance of the machine during a particular event or set of events during which the machine performs some function, e.g., an acceleration event, a braking event, a turning event, etc. System 100 may then compare the performance of the machine during the event to the historical performance of the machine (or one or more other machines) during a corresponding event.

In an exemplary embodiment where system 100 may be included in one or more autonomous machines, the machine may be programmed with an event schedule identifying the functions that the machine is to perform (e.g., identifying a sequence of events). Thus, system 100 may compare the performance of the machine during a particular event (e.g., during a particular scheduled braking event) to the performance of the machine (and/or one or more other machines) during historical events corresponding to the particular event (e.g., to times in the past when the machine and/or one or more other machines performed the same scheduled braking event during a previous execution of the event schedule). Other events, such as an emergency braking event, may not be scheduled, but system 100 may also compare similar non-scheduled events according to the embodiments discussed in greater detail below.

The performance of the machine during a particular event may be measured by determining a command value of a command sent to one or more components of the machine in order to achieve a desired output parameter value associated with the event. For example, if the event is a braking event, the desired output parameter value for the event may be a particular deceleration value and/or stopping distance. System 100 may determine a command value required to achieve the deceleration value and/or stopping distance. For example, system 100 may determine a command value to be the brake line pressure required to achieve this desired output parameter value. Similarly, system 100 may determine a command value based on an electronic signal that corresponds to the brake line pressure (e.g., measured in terms of the current and/or voltage applied to a brake line pressure control input). In another example where the event is an acceleration event, system 100 may determine a fuel injection command value required to achieve a desired acceleration value. Other events may also be used to analyze machine performance, such as turning events or any other event that may correspond to any function performed by the machine. Also, for each event, one or more machine state parameters, such as the velocity, orientation, payload, etc., of the machine may also be taken into account when assessing machine performance, as discussed in greater detail below.

Sensors 120-170 of system 100 may be positioned at different locations on the machine and may be configured to measure different parameters of the machine. For example, GNSS device 120 may include one or more GNSS receivers (e.g., global positioning system (GPS) receivers) capable of determining values for one or more machine state parameters (i.e., machine state parameter values). A machine state parameter value may include some information regarding the state of the machine. For example, GNSS device 120 may determine values for machine state parameters such as machine location, velocity, acceleration, orientation (e.g., elevation, bank, and/or heading), etc. GNSS device 120 may send one or more of these machine state parameter values to controller 110. In certain embodiments, GNSS device 120 may determine and output values for several different machine state parameters. In other embodiments, GNSS device 120 may output values for a particular machine state parameter, such as location values, and controller 110 may calculate other machine state parameter values based on the location values. For example, controller 110 may calculate the velocity and acceleration values of the machine in one or more directions with respect to the machine (e.g., forward acceleration, lateral acceleration, etc.) using a series of machine location values measured by GNSS device 120 over time.

Likewise, GNSS device 120 may include two or more GNSS receivers separated by known distances, and controller 110 may determine the orientation (e.g., elevation, bank, and/or heading) of the machine by comparing the outputs from the GNSS receivers. Elevation may be defined as a rotational angle of the machine measured about an axis extending along a lateral direction the machine, i.e., from side to side of the machine. For example, elevation may be the same as the grade or pitch of the machine. Bank may be defined as a rotational angle of the machine measured about an axis extending along a direction of forward motion of the machine, i.e., from front to back of the machine. For example, bank may be the same as the roll of the machine. Heading may be defined as the angle of the machine measured about an axis extending along a direction from the top of the machine to the bottom of the machine. For example, heading may be the same as the yaw of the machine.

IMU 130 may include one or more accelerometers, gyroscopes, and/or pendulous-based inclinometers and may also be configured to determine one or more machine state parameter values. For example, IMU 130 may be configured to determine values for machine state parameters such as machine acceleration, orientation, etc. IMU 130 may likewise output one or more of these machine state parameter values to controller 110. For example, IMU 130 may output acceleration and/or orientation parameter values to controller 110. Controller 110 may also use certain machine state parameter values (e.g., acceleration) received from IMU 130 to determine other machine state parameter values (e.g., location, velocity, etc.).

Speed sensor 140 may include one or more speed sensors, e.g., positioned on a wheel shaft of the machine (for wheel-based machines) or a track driving sprocket of the machine (for track-based machines). In certain embodiments, speed sensor 140 may include an encoder, such as a high precision speed encoder positioned on the wheel set to measure the rotational speed of the wheels and thus determine the velocity of the machine. Speed sensor 140 may also be configured to send data indicating a speed of the machine to controller 110. As discussed, controller 110 may be capable of determining other information, e.g., acceleration, from a time series of speed data.

Brake sensor 150 may include one or more devices capable of measuring a degree to which the brakes of the machine are being applied. For example, brake sensor 150 may include sensors that detect pressure in one or more brake lines or hoses of the machine. Brake sensor 150 may also be configured to send data that indicates the amount of pressure being applied in one or more of the brake lines or hoses to controller 110.

Fuel sensor 160 may include one or more sensors capable of measuring an amount of fuel being injected to an engine of the machine. For example, fuel sensor 160 may include sensors that detect a pressure, flow rate, and/or volume of fuel in a fuel line or hose that supplies fuel to the engine. Fuel sensor 160 may also be configured to send data corresponding to the amount (e.g., via pressure, flow rate, and/or volume) of fuel being applied to the engine to controller 110.

Payload sensor 170 may include one or more sensors capable of measuring a weight of the payload of the machine. For example, payload sensor 170 may be capable of measuring the weight of the material being moved by the machine. Payload sensor 170 may also be configured to send data corresponding to the weight of the payload being carried by the machine to controller 110.

Steering sensor 175 may include one or more sensors capable of measuring a steering angle and/or radius of curvature of a path of the machine. For example, steering sensor 170 may include one or more steering angle sensors mounted on a steering shaft of the machine and enabled to detect the steering angle. Steering sensor 175 may also include one or more force sensors, tire pressure sensors, and/or accelerometers that may be configured to measure data used to determine a steering angle of the machine.

Database 180 may be configured to store data used by system 100 to analyze machine performance. For example, database 180 may store historical data related to different events of the machine and/or one or more other machines. In certain embodiments, database 180 may store the information corresponding to each event as a multidimensional data point. For example, for any braking event, database 180 may store a data point ($C_b$, $D_d$, v, θ, P), where $C_b$ corresponds to the braking command value that was applied to achieve a desired deceleration value $D_d$ associated with the braking event when the machine is traveling at a velocity v, at an elevation angle θ, and carrying a payload P. For example, as discussed above, a deceleration of the machine as well as velocity v, elevation angle θ and payload weight P may be measured by one or more of sensors 120-170. Controller 110 may receive this data from sensors 120-170, construct a data point for the event, and store the data point in database 180. Similarly, for an acceleration event, database 180 may store a data point ($C_f$, $A_d$, v, θ, P), where $C_f$ corresponds to the fuel injection command value that was applied to achieve a desired acceleration value $A_d$ associated with the acceleration event when the machine is traveling at a velocity v, at an elevation angle θ, and carrying a payload P. Likewise, for any turning event, database 180 may store a data point ($C_t$, $A_c$, v, θ, ϕ, P), where $C_t$ corresponds to a turning command (e.g., a radius of curvature) that results in a centripetal acceleration value $A_c$ when the machine is traveling at a velocity v, at an elevation angle θ, at a bank angle ϕ, and carrying a payload P. Of course, data points for any other type of event may also be stored in database 180. Moreover, while data points are used as an exemplary format, those skilled in the art will appreciate that any other type of format, including arrays, tables, etc., may be used to store the data associated with the events.

In certain embodiments, such as where the machine is an autonomous machine, database 180 may store data points for corresponding events together as a set of data points. For example, as discussed, the machine may perform certain events with regularity as part of an event schedule that defines the tasks performed by an autonomous machine. The event schedule may include a number of braking events, $BE_i$, acceleration events $AE_i$, etc., that are performed at particular times and/or locations within the event schedule. For example, if the machine is an autonomous machine that moves materials from one location to another, then the machine may include a braking event $BE_i$ before the machine dumps the material, and an acceleration event $AE_i$ after the machine dumps the material and moves to return to pick up additional material. In these embodiments, database 180 may store data points for corresponding events together. For example, database 180 may store the data points for all instances of a particular braking event $BE_2$ together so that these data points may be used together to analyze machine performance.

Database 180 may also store other information, such as the event schedule itself, or any other information that controller 110 may use to control the machine. For example, database 180 may store one or more threshold values as discussed in various embodiments below. Moreover, while database 180 is shown in FIG. 1 as being separate from controller 110, database 180 may also be incorporated together with controller 110, such as in one or more memories and/or storages of controller 110, as discussed below.

Network 190 may include any one of or combination of wired or wireless networks. For example, network 190 may include wired networks such as twisted pair wire, coaxial cable, optical fiber, and/or a digital network. Network 190 may further include any network configured to enable communication via a CAN-bus protocol. Likewise, network 190 may include any wireless networks such as RFID, microwave or cellular networks or wireless networks employing, e.g., IEEE 802.11 or Bluetooth protocols. Additionally, network 190 may be integrated into any local area network, wide area network, campus area network, or the Internet.

Controller 110 may include a processor 111, a storage 112, and a memory 113. Controller 110 may include or be included in an electronic control unit of the machine, such as an engine control unit (ECU), for example. Controller 110 may be configured to analyze machine performance and determine whether and when a machine may require maintenance, as discussed below. Processor 111 may include one or more known processing devices, such as a microprocessor from the Pentium™ or Xeon™ family manufactured by Intel™, the Turion™ family manufactured by AMD™ or any other type of processor. Storage 112 may include a volatile or non-volatile, magnetic, semiconductor, tape, optical, removable, nonremovable, or other type of storage device or computer-readable medium. Storage 112 may store programs and/or other information, such as performance analysis and/or maintenance scheduling programs, information related to historical machine performance, and/or any other information used to assess current machine performance, as discussed in greater detail below. Memory 113 may include one or more storage devices configured to store information used by controller 110 to perform certain functions related to disclosed embodiments.

In one embodiment, memory 113 may include one or more machine performance analysis programs or subprograms loaded from storage 112 or elsewhere that, when executed by processor 111, perform various procedures, operations, or processes consistent with the disclosed embodiments. For example, memory 113 may include one or more programs that enable controller 110 to, among other things, identify an event for a machine that includes a desired output parameter value, send a command to a certain component of a machine to achieve the desired output parameter value, assess the performance of the machine, and determine whether the machine requires maintenance by comparing the value of the command sent to the component of the machine with historical command values sent to the machine under similar circumstances.

For example, memory 113 may include one or more programs that enable processor 111 to identify a braking event that includes a desired deceleration output parameter value, send a braking command indicative of a braking pressure to be applied to the brake lines of the machine, and assess the machine performance by comparing the braking command to previous braking commands sent when a corresponding event in the event schedule was completed sometime in the past. In these embodiments, as one or more components of the machine's braking system, such as the brake pads wear down, the braking command given to achieve the desired deceleration value may increase over time. Thus, by comparing the braking command to corresponding historical braking commands, in accordance with one or more embodiments discussed below, controller 110 may be able to determine if and when a particular machine requires maintenance.

Likewise, in the example of an acceleration event, memory 113 may include one or more programs that enable processor 111 to identify the acceleration event including a desired acceleration output parameter value, send a fuel injection command indicative of an amount of fuel to be injected into an engine of the machine, and assess the machine performance by comparing the fuel injection command to previous fuel injection commands sent when a corresponding fuel injection event was completed in the past. As discussed, any other event executed by the machine, such as turning events, for example, also may be used to assess machine performance.

Figure 2:
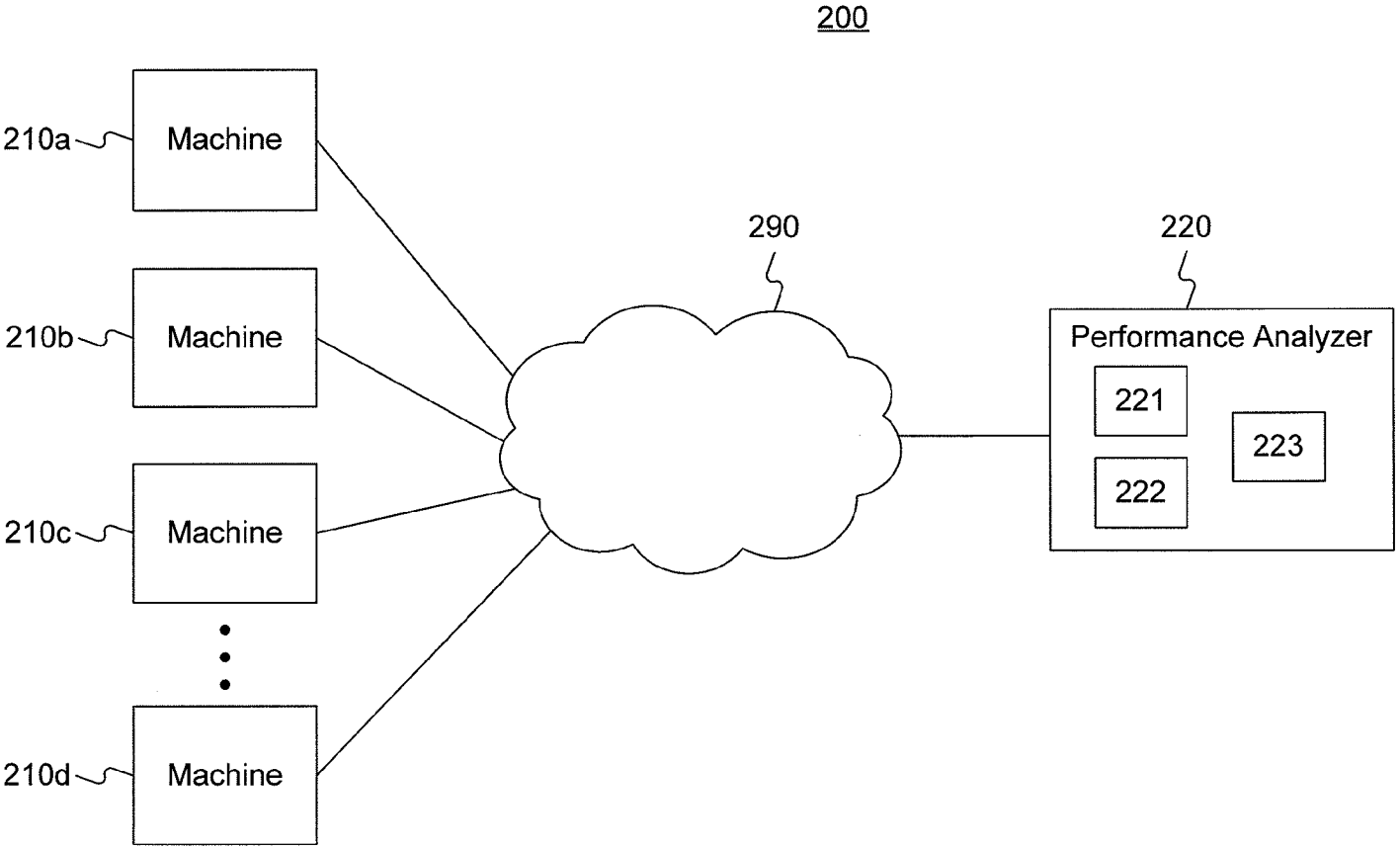
FIG. 2 is a diagrammatic illustration of another exemplary disclosed performance analysis system that may include a plurality of machines.

FIG. 2 illustrates another exemplary performance analysis system 200 having machines 210*a*-210*d* connected to a performance analyzer 220 via a network 290. Machines 210*a*-210*d* may be any type of machine capable of performing tasks such as digging, loosening, carrying, drilling, compacting, etc., different materials. Machines 210*a*-210*d* may each include one or more components of system 100 and may include any of the functionalities described herein with respect to those components. For example, machines 210*a*-210*d* may each include one or more of sensors 120-170 and/or controller 110. While four machines 210*a*-210*d* are shown in FIG. 2, system 200 may include any number of machines.

In certain embodiments, machines 210*a*-210*d* may be autonomous machines that operate as part of a fleet to perform tasks according to event schedules. For example, machines 210*a*-210*d* may be configured to operate according to similar or identical event schedules, such that machines 210*a*-210*d* each perform similar or identical tasks in a predetermined order, e.g., loading material at a particular location (which may include a braking event, a loading event, etc.), traveling to another location (which may include acceleration, turning, and/or braking events), unloading the material at the other location (which may include a braking event, a dumping event, etc.), etc.

Machines 210*a*-210*d* also may be configured to send data regarding tasks performed during a particular event to performance analyzer 220 via network 290. For example, machines 210*a*-210*d* may be configured to send command values, actual output parameter values, desired output parameter values, and/or machine state parameter values to performance analyzer 220 for a particular event. Thus, as discussed above, where the event is a braking event, one or more of machines 210*a*-210*d* that are braking during the event may each send one or more of a braking command value $C_b$, a desired deceleration value $D_d$ and/or an actual deceleration value $D_a$, a velocity value v, an elevation angle θ, and payload value P. Similarly, when the event is an acceleration event, machines 210*a*-210*d* may each send one or more of a fuel injection command $C_f$, a desired acceleration value $A_d$ and/or an actual acceleration value $A_a$, a velocity value v, an elevation angle θ, and payload value P. Likewise, when the event is a turning event, machines 210*a*-210*d* may each send one or more of a turning command $C_t$, an actual centripetal acceleration value $A_c$, a velocity value v, an elevation angle θ, a bank angle ϕ, and payload value P. In certain embodiments, machines 210*a*-210*d* may generate data points, e.g., using the data point formats discussed above, at their respective controllers 110, and send the data points to performance analyzer 220.

Performance analyzer 220 may receive the data from machines 210*a*-210*d* and analyze the data to determine if and when one or more of machines 210*a*-210*d* may require maintenance. For example, performance analyzer 220 may compare the data received from machines 210*a*-210*d* to historical data previously received from machines 210*a*-210*d* and/or any other machines performing tasks in accordance with the event schedule to determine if and when one or more of machines 210*a*-210*d* may require maintenance.

As shown in FIG. 2, performance analyzer 220 may include a processor 221, a storage 222, and a memory 223. Processor 221 may include one or more known processing devices, such as a microprocessor from the Pentium™ or Xeon™ family manufactured by Intel™, the Turion™ family manufactured by AMD™ or any other type of processor. Storage 222 may include a volatile or non-volatile, magnetic, semiconductor, tape, optical, removable, nonremovable, or other type of storage device or computer-readable medium. Storage 222 may store programs and/or other information, such as information related to historical performance of one or more machines in the fleet and/or any other information used to assess current machine and/or fleet performance, as discussed in greater detail below. Memory 223 may include one or more storage devices configured to store information used by performance analyzer 220 to perform certain functions related to disclosed embodiments. In certain embodiments, storage 222 and/or memory 223 may store information similar to that discussed above with regard to database 180 for one or more of machines 210*a*-210*d* in the fleet. That is, storage 222 and/or memory 223 may include the data points corresponding to one or more events for machines 210*a*-210*d*.

In one embodiment, memory 223 may include one or more machine performance analysis programs or subprograms loaded from storage 222 or elsewhere that, when executed by processor 221, perform various procedures, operations, or processes consistent with the disclosed embodiments. For example, memory 223 may include one or more programs that enable performance analyzer 220 to, among other things, identify an event for a machine 210*a* among a plurality of machines 210*a*-210*d* that includes a desired output parameter value, receive a command value indicative of a command sent to a component of machine 210*a*, assess the performance of machine 210*a*, and determine whether machine 210*a* requires maintenance by comparing the command value to historical command values sent to one or more other machines 210*b*-210*d* in the fleet under similar circumstances. For example, memory 223 may include one or more programs that enable processor 221 to identify a braking event for machine 210*a* that includes a desired deceleration output parameter value, receive a braking command value indicative of a braking command sent to a braking system of machine 210*a*, and assess the machine performance by comparing the braking command value to previous braking command values for one or more other machines 210*b*-210*d* during the same event in the event schedule completed sometime in the past. As discussed, other events, such as acceleration and/or turning events may also be used to analyze machine performance.

Network 290 may include any one of or combination of wired or wireless networks. For example, network 290 may include wired networks such as twisted pair wire, coaxial cable, optical fiber, and/or a digital network. Network 290 may further include any network configured to enable communication via a CAN-bus protocol. Likewise, network 290 may include any wireless networks such as RFID, microwave or cellular networks or wireless networks employing, e.g., IEEE 802.11 or Bluetooth protocols. Additionally, network 290 may be integrated into any local area network, wide area network, campus area network, or the Internet.

Figure 3:
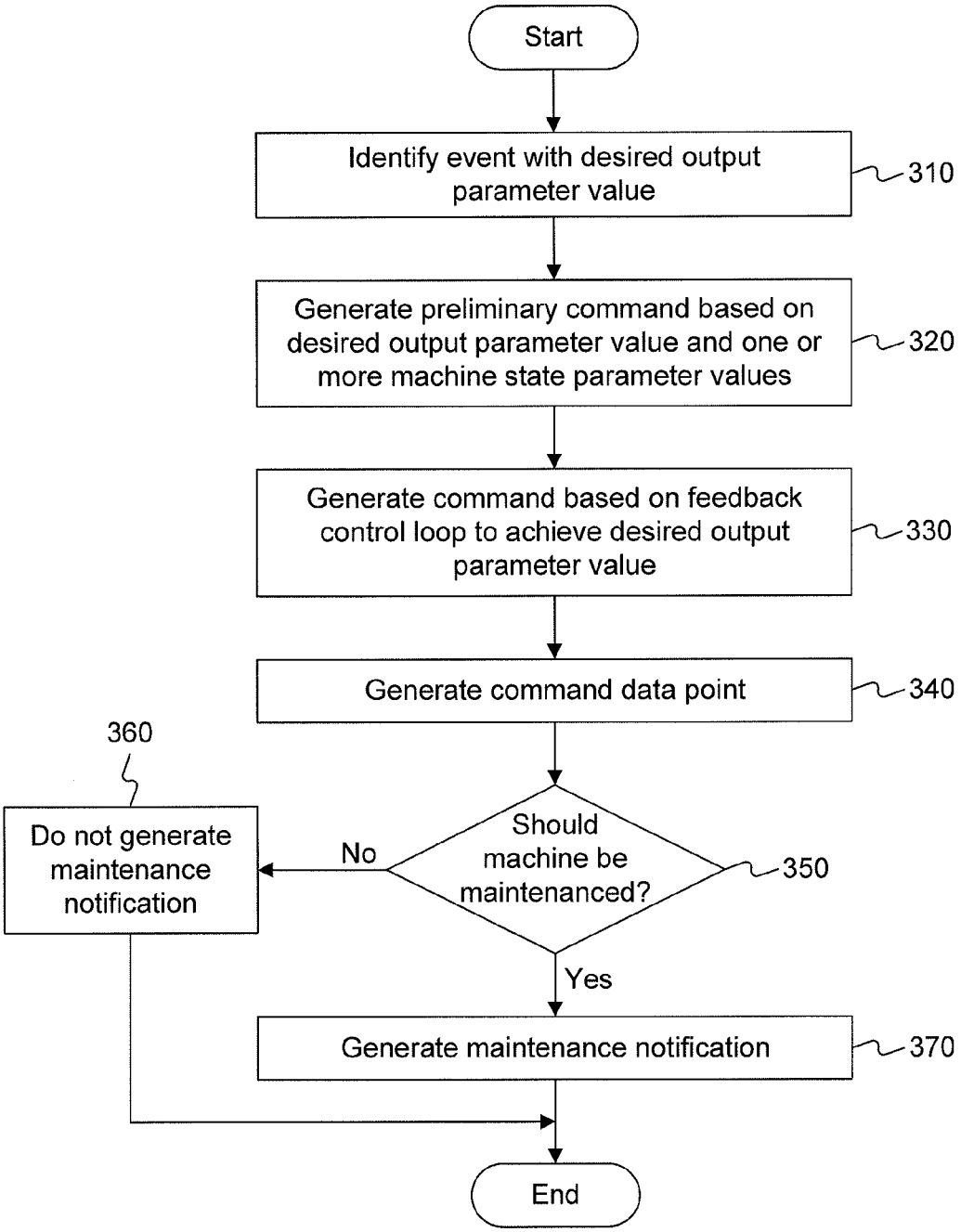
FIG. 3 is a flowchart depicting an exemplary disclosed method that may be performed by one or more components in the system of FIG. 1.

FIG. 3 is a flowchart illustrating exemplary processes for analyzing machine performance, consistent with disclosed embodiments. The processes of FIG. 3 may be performed by one or more components of system 100 shown in FIG. 1, such as controller 110, for example. System 100 may identify an event having a desired output parameter value (step 310). For example, system 100 may identify an event included in an event schedule during which the machine that includes system 100 may perform one or more tasks. A braking event is used here as an example. However, those skilled in the art will understand that other events, such as an acceleration event, a turning event, etc., may also be used to analyze machine performance, consistent with the disclosed embodiments. The exemplary braking event may be associated with a desired braking deceleration value. That is, for the particular braking event, it may be desired that the machine decelerate at a particular rate. For example, different braking events may be associated with different desired output parameter values (e.g., different desired deceleration values)—a scheduled braking event may have one desired deceleration value, while another braking event, such as an emergency braking event may have a different deceleration value. Likewise, different acceleration events may have different desired acceleration values.

After identifying the event, system 100 may generate a preliminary command having a preliminary command value to be sent to a component of the machine, such as a braking system of the machine (step 320). The preliminary command may be generated based on the desired output parameter value and one or more machine state parameter values. For example, system 100 may determine a command value to apply based on one or more control maps stored at database 180 and/or controller 110 that map suggested braking command values to different combinations of desired deceleration values and machine state parameter values. Using the braking event example, a control map stored at database 180 and/or controller 110 may correlate suggested braking command values to different combinations of desired deceleration values and machine state parameter values such as machine velocity, orientation, and payload. The control map may be represented as multidimensional functions that output a command value as a function of an output parameter value and set of machine state parameter values. The control map may also be represented as a set of sample data points representing exemplary combinations of output parameter values and machine state parameter values with corresponding exemplary command values. System 100 may then determine the preliminary command value for a particular event based on one or more closest data points in the control map, e.g., using one or more interpolation techniques.

In still other embodiments, the control map of database 180 and/or controller 110 may include a preliminary command having a preliminary command value that corresponds to the particular event. Thus, for a particular braking event $BE_i$, the control map may store a certain braking command value as the preliminary command value. Likewise, for another braking event $BE_{i+1}$, the control map may store a different braking command value.

System 100 may also use one or more feedback control loops to modify the command value applied in order to achieve the desired output parameter value (step 330). For example, controller 110 may include one or more control loops, such as a proportional-integral-derivative (PID) control loop that modifies the command value being applied to the machine in order to achieve the desired output parameter value. In the braking event example, system 100 may monitor the deceleration of the machine after the preliminary command value is applied and compare the deceleration to the desired deceleration value (i.e. the desired output parameter value). Then, controller 110 may modify the command value such that the actual deceleration of the machine is equal to or approaches the desired deceleration value.

System 100 may generate a command data point corresponding to the command value for the event (step 340). For example, controller 110 may generate a data point that includes the final command value generated as a result of the feedback control loop. In certain embodiments, the data point may also include the desired output parameter value and one or more machine state parameter values. In the braking example, controller 110 may generate a data point ($C_b$, $D_d$, v, θ, P), where $C_b$ corresponds to the braking command value that was applied to achieve a desired deceleration value $D_d$ associated with the braking event when the machine is traveling at a velocity v, at an elevation angle θ, and carrying a payload P. As discussed above the actual deceleration of the machine as well as velocity v, elevation angle θ, and payload weight P may be measured by one or more of sensors 120-170. In the acceleration event example, controller 110 may generate a data point ($C_f$, $A_d$, v, θ, P), where $C_f$ corresponds to the fuel injection command value that was applied to achieve a desired acceleration value $A_d$ associated with the acceleration event when the machine is traveling at a velocity v, at an elevation angle θ, and carrying a payload P. For the turning event example, controller 110 may generate a data point ($C_t$, $A_c$, v, θ, P), where $C_t$ corresponds to a turning command (e.g., a radius of curvature) that results in a centripetal acceleration value when the machine is traveling at a velocity v, at an elevation angle θ, at a bank angle ϕ, and carrying a payload P. As discussed above, these data points may be stored in database 180 which may be included as a part of or separately from controller 110.

The command values discussed above may be generated or otherwise determined by controller 110. Alternatively or additionally, the command values may be determined by one or more sensors. For example, brake sensor 150 may determine a braking command $C_b$, fuel sensor 160 may determine a fuel injection command $C_f$, etc. Additionally, as discussed, several of sensors 120-170 may be capable of measuring acceleration values and/or measuring other values used to determine acceleration values of the machine, such as GNSS device 120, IMU 130, and speed sensor 140. System 100 may use one or more of these sensors to determine the acceleration or deceleration for an event, e.g., by combining values from the sensors, choosing one sensor over another based on accuracy or trustworthiness, or any other method.

System 100 may then use the data point generated in step 340 to determine if and when the machine may require maintenance (step 350). For example, system 100 may determine if and when the machine may require maintenance by analyzing the data point generated in step 340 with respect to one or more historical data points that were generated previously. The historical data points may have been generated based on similar events executed by the same or different machines. For example, the historical data points may have been generated during the same event in a previous execution of the event schedule for the machine. System 100 may use one or more different analysis techniques to determine if and when the machine may require maintenance, as discussed below.

One exemplary technique may include comparing the command value to a threshold command value for the event. For example, system 100 may store threshold command values for one or more of the events in an event schedule, e.g., in database 180 or elsewhere. In certain embodiments, the threshold command values may be predetermined based on specifications of the machine. In other embodiments, the threshold command values may be determined based on historical command values generated during previous events. For example, the threshold command value may be set to a value equal to a historical command value that was generated at or near the time when it was previously determined that the machine may require maintenance. In one embodiment, the threshold command value may be set to a value that is a certain percentage, such as 90%, of a historical command value that was generated at or near the time when a machine experienced downtime or some failure. According to this technique, system 100 may compare the command value to the threshold command value, and, if the command value exceeds the threshold command value, may determine that the machine may require maintenance.

Another exemplary technique may include comparing a rate of change of the command values for a particular event to a threshold command value rate of change. For example, as discussed above, the events may be included in an event schedule. Thus, based on the event schedule, the machine may perform the particular event at regular intervals. Thus, as the machine performs the event during subsequent executions of the event schedule, system 100 may generate multiple command data points over time. Accordingly, system 100 may be able to calculate a rate of change of the command value applied for a certain event over time. Returning to the braking event example, the braking command value applied to achieve a desired deceleration value associated with a particular braking event may increase over time, e.g., based on wear in the brake pads. A larger-than-expected increase in the braking command value over time may indicate that the brake pads are wearing away faster than expected, and may thus signal that maintenance may be required sooner than expected, or may signal other problems, such as one or more faulty brake pads. Thus, system 100 may calculate the change in command values over time (e.g., may determine time derivatives for discrete command value points) and may compare the change in command values over time to a threshold command value rate of change. If the time rate of change of the command values for a particular event exceeds a threshold rate of change, then system 100 may determine that the machine may require maintenance.

Figure 4:
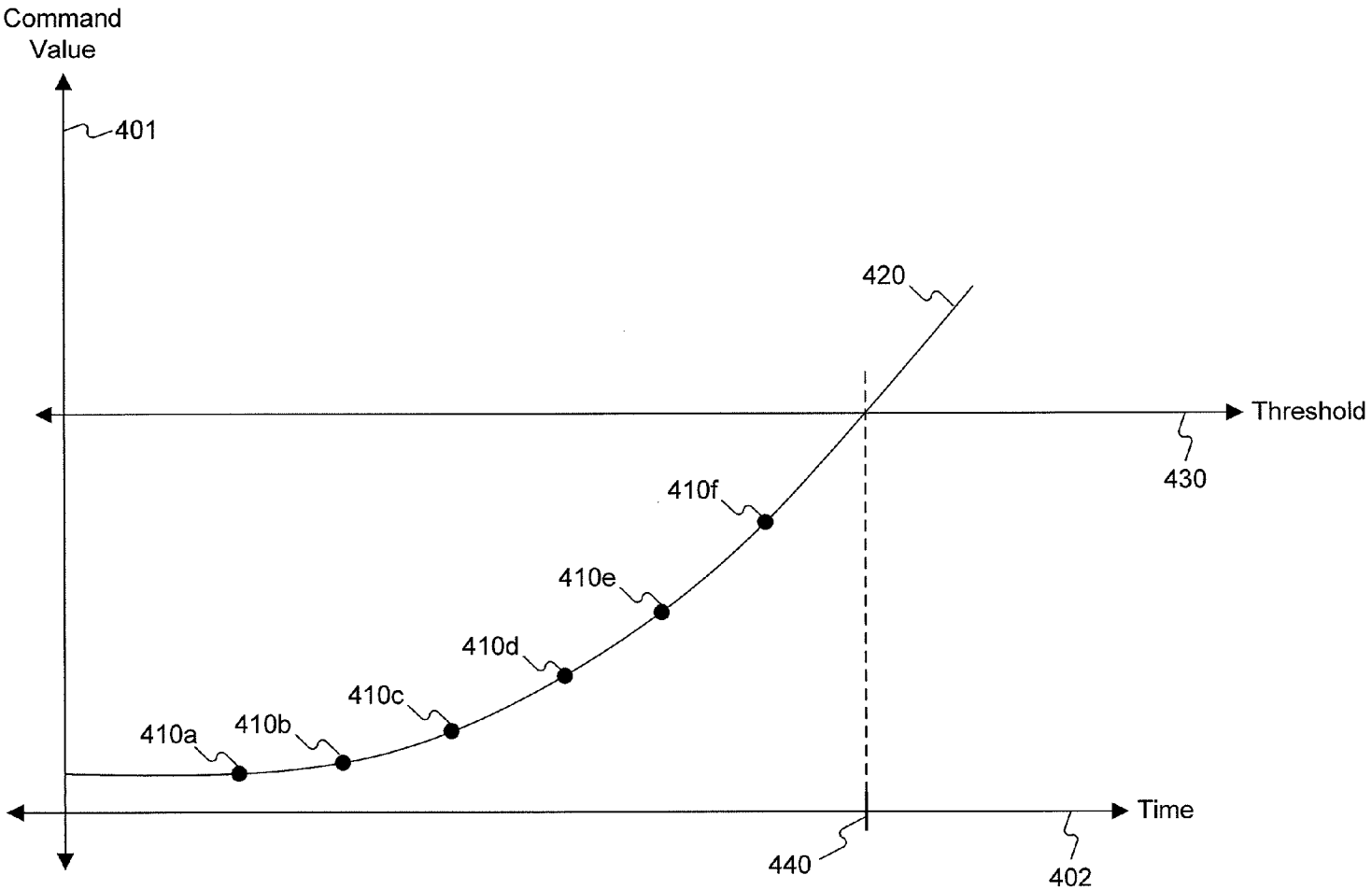
FIG. 4 is an exemplary illustration of an exemplary disclosed maintenance projection technique that may be performed by one or more components in the systems of FIGS. 1 and 2.

Another exemplary technique that may be performed by system 100 as a part of step 350 may include determining a trend in a time series of the command values for a particular event and determining if and when the machine requires maintenance based on the trend. For example, system 100 may analyze the trend in a time series of the command values by generating an equation that represents the trend in the time series of the command values, e.g., using one or more curve fitting techniques or algorithms. That is, system 100 may generate an equation to represent a time series of command values by fitting a curve defined by the equation to a time series of previously collected command values. For example, FIG. 4 illustrates a time series of points 410*a*-410*f* that each have a command value that was collected at a particular time, as illustrated by their positioning in the graph having command value axis 401 and time value axis 402. System 100 may use one or more curve fitting algorithms to derive an equation for curve 420 that best fits the time series of points 410*a*-410*f* representing the command values.

System 100 may then use the equation for curve 420 to determine if and when the machine may require maintenance. For example, system 100 may determine a time 440 in the future when curve 420 representing the best fit equation exceeds a threshold command value 430. Thus, system 100 may use the equation to extrapolate curve 420 to a time in the future in order to identify a projected machine maintenance date at which the value of the equation represented by curve 420 exceeds threshold command value 430.

Alternatively or additionally, system 100 may calculate a rate of change of the equation represented by curve 420 (i.e. may calculate a time-based derivative of curve 420) at one or more times in the future and may determine a projected machine maintenance date based on the rate of change. For example, system 100 may include an expected command value trend rate of change. The expected command value trend rate of change may be based, e.g., on historical command value trend rates of change of other machines. For example, if the machine being analyzed is one machine within a fleet, then the expected command value trend rate of change may be determined based on a mean or median command value trend rate of change of one or more other machines in the fleet. System 100 may identify a projected machine maintenance date to be a date when a rate of change of the equation represented by curve 420 exceeds the expected command value trend rate of change by a threshold value. In certain embodiments, the threshold value may be based on the expected command value trend rate of change. For example, the threshold value may be a predetermined percentage of the expected command value trend rate of change, such as, 20%. Thus, system 100 may identify as the projected machine maintenance date a point of time in the future where the rate of change of curve 420 exceeds the expected command value trend rate of change by 20%.

Another exemplary technique that may be performed by system 100 may take into account other values in addition to the command values, such as machine state parameter values, when analyzing machine performance. For example, as discussed, system 100 may include data points for different events, such as a data point ($C_b$, $D_d$, v, θ, P) for a braking event, a data point ($C_f$, $A_d$, v, θ, P) for an acceleration event, and a data point ($C_t$, $A_c$, v, θ, ϕ, P) for a turning event. When analyzing machine performance to determine whether the machine may require maintenance, system 100 may determine a distance between each data point and a multidimensional surface (optionally represented by a set of multidimensional points) that define an expected or desirable operational range for the machine. This multidimensional surface may be predefined, e.g., based on specifications of the machines, historical data of the fleet (e.g., previously collected data points), or a combination of both and may be stored in system 100, e.g., in database 180 and/or controller 110. System 100 may then determine that the machine requires maintenance when a difference between the data point for an event and the multidimensional surface exceeds a threshold value for that event. The threshold values for certain events may also be stored in system 100.

If, at step 350, system 100 determines that the machine may require maintenance (step 350, Yes), then system 100 may generate a maintenance notification (step 370). If the machine is a non-autonomous machine, the maintenance notification may be sent to an operator of the machine. If the machine is an autonomous machine, the maintenance notification may be sent to a central controller, e.g., that controls operations for one or more autonomous machines. If, on the other hand, system 100 determines that the machine does not require maintenance (step 350, No), then system 100 may not generate a maintenance notification (step 360) and the process implemented by system 100 for that particular event may end.

Figure 5:
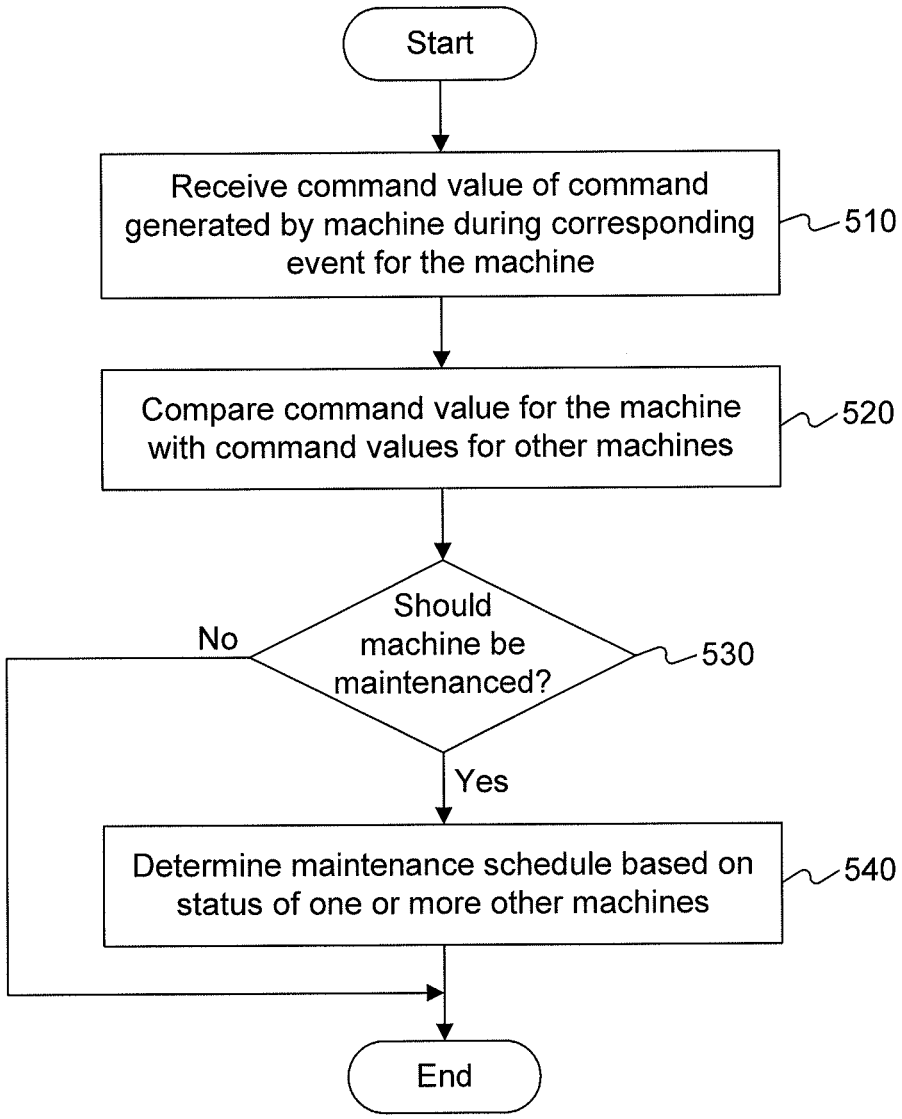
FIG. 5 is a flowchart depicting an exemplary disclosed method that may be performed by one or more components in the system of FIG. 2.

As discussed above, performance analyzer 220 may receive data from one or more of machines 210*a*-210*d* in a fleet and analyze the data to determine if and when one or more of the machines require maintenance. FIG. 5 is a flowchart that illustrates exemplary processes for analyzing machine performance, which may be performed by performance analyzer 220, for example.

Performance analyzer 220 may perform one or more of the steps included in FIG. 5 each time a machine executes an event. Thus, for each event executed by a machine within a fleet of machines, performance analyzer 220 may analyze the performance of the machine, determine whether the machine may require maintenance, and/or determine a maintenance schedule for the fleet of machines. If machines 210*a*-210*d* are part of a fleet of machines performing related tasks, then machines 210*a*-210*d* may each execute the event schedules such that each machine 210*a*-210*d* performs the events in the event schedule offset in time relative to the other machines. That is, when machine 210*a* is executing tasks for a particular event (e.g., braking event $BE_1$) at a particular point in time in the event schedule, then machine 210*b* may be executing tasks for a different event (e.g., acceleration event $AE_2$) at a different point in time in the event schedule. Thus, while machines may perform corresponding events at substantially the same time within an event schedule, the machines may execute the event schedule in a staggered fashion. This may allow the machines to work together to perform similar tasks without interfering with each other in the field. Performance analyzer 220 may perform the processes of FIG. 5 for multiple machines in the fleet at the same time, analyzing command values for different events as they are executed by the machines in the fleet.

Performance analyzer 220 may receive a command value of a command generated by one of machines 210*a*-210*d* (e.g., machine 210*a*) during an event (step 510). For example, as each machine completes tasks for an event (e.g., a braking event, an acceleration event, a turning event, etc.) in an event schedule, the machine may send data to performance analyzer 220 that is indicative of the commands sent to different components of the machine (e.g., a braking system, an engine system, a steering system, etc.). In addition to command values, this data may also include machine state parameter values indicative of a current state of the machine when the command was issued. For example, each machine may also send data corresponding to an acceleration, deceleration, velocity, position, orientation, payload weight, etc., of the machine. As discussed, this data may be sent to performance analyzer 220 as multidimensional data points that include the command value, a desired output parameter value, and/or one or more state parameter values.

Performance analyzer 220 may compare the command value for the machine with command values for the other machines (step 520). In certain embodiments, performance analyzer 220 may compare command values for a machine with command values for the other machines that correspond to the same event. For example, if machine 210*a* has executed a scheduled braking event $BE_2$ that is part of the event schedule, performance analyzer 220 may compare the command value for braking event $BE_2$ with the command values for the other machines in the fleet when they executed braking event $BE_2$ during their event schedule.

In some embodiments, performance analyzer 220 may compare the command values for corresponding events directly, without consideration of machine state parameter values such as machine velocity, machine payload, and/or machine orientation, because performance analyzer 220 may assume that these parameters are the same for corresponding events. In other embodiments, performance analyzer 220 may take into account the measured machine state parameter values in a variety of ways.

According to one embodiment, performance analyzer 220 may compare machine state parameter values during the event for the machine being analyzed to historical machine state parameter values for other machines in the fleet during corresponding events. For example, performance analyzer 220 may compare the machine state parameter values to mean or median values of the historical machine state parameter values. If the machine state parameter value differs from the mean or median by less than a threshold value for that machine state parameter value, then performance analyzer 220 may assume that the machine state parameter values are equal and may directly compare the command values.

According to another embodiment, performance analyzer 220 may store data points for different events, as discussed above. For example, for each braking event executed by a machine, performance analyzer 220 may store a data point ($C_b$, $D_d$, v, θ, P) for that particular execution of the event. Likewise, performance analyzer 220 may store a data point ($C_f$, $A_d$, v, θ, P) for acceleration events and a data point ($C_i$, v, θ, ϕ, P) for turning events. Performance analyzer 220 may then determine a distance between each data point and a multidimensional surface (optionally represented by a set of multidimensional points) that define an expected or desirable operational range for the machines. This multidimensional surface may be predefined, e.g., based on specifications of the machines, historical data of the fleet (e.g., previously collected data points), or a combination of both.

Performance analyzer 220 may then determine whether any of the machines may require maintenance (step 530). Performance analyzer 220 may do so based on the comparison performed at step 520. For example, performance analyzer 220 may use one or more of the techniques discussed above with respect to step 350 of FIG. 3, except that instead of using the historical data of the same machine (e.g., machine 210*a*) as a comparison, performance analyzer 220 may use the historical data from one or more other machines in the fleet. For example, performance analyzer 220 may compare the command value of machine 210*a* at an event to an average of the historical command values of one or more other machines in the fleet (and optionally also of historical command values of machine 210*a*) to the command value of machine 210*a*, and, if the difference between the command value and the average exceeds a threshold value, may determine that the machine requires maintenance.

In embodiments where performance analyzer 220 stores data points for different events, as discussed above, performance analyzer 220 may determine that the machine requires maintenance when a difference between the data point for an event and the multidimensional surface exceeds a threshold value.

Performance analyzer 220 may determine a maintenance schedule for the machine based on the status of one or more other machines in the fleet (step 540). As discussed above, performance analyzer 220 may perform the processes of FIG. 5 for each event executed by each machine, in certain embodiments. Thus, performance analyzer 220 may continuously analyze the performance of each machine and determine if each machine in the fleet requires maintenance. However, it may be impractical to send two or more machines off line for maintenance at the same time. Thus, performance analyzer 220 may determine maintenance schedules for the machines based on the status of all of the machines.

For example, if performance analyzer 220 determines that machine 210*a* requires maintenance and also determines, at or around the same time, that machine 210*b* requires maintenance, then performance analyzer 220 may determine which machine should be scheduled for maintenance first.

Performance analyzer 220 may take many factors into account when prioritizing the maintenance schedule of machines in the fleet. For example, performance analyzer 220 may determine that a certain system, such as the braking system, receives a maintenance priority over an engine system and/or a steering system. Thus, if machine 210*a* requires braking maintenance and machine 210*b* requires steering maintenance, then performance analyzer 220 may determine that machine 210*a* should receive maintenance first and machine 210*b* can receive maintenance after machine 210*a*.

Likewise, if both machines 210*a* and 210*b* require similar maintenance (e.g., both require braking maintenance), then performance analyzer 220 may schedule the machine with the higher command value for a particular event to receive maintenance first. In other words, if the command value for machine 210*a* for a braking event $BE_1$ is higher than a command value for machine 210*b* for the same braking event $BE_1$ under similar circumstances (e.g., similar vehicle speed, payload, and orientation), then performance analyzer 220 may determine that machine 210*a* should receive maintenance first because the higher command value may indicate a greater wear in the brake pads.

Industrial Applicability

The disclosed machine performance analysis systems and methods may be applicable to any type of machine, including autonomous and non-autonomous machines that perform tasks such as digging, loosening, carrying, drilling, compacting, etc., different materials, and may require maintenance from time to time. The disclosed machine performance analysis systems and methods may allow an organization to monitor the performance of one or more machines and leverage historical data to predict if and when a machine may require maintenance. By being able to predict maintenance times, the organization can reduce the downtime of a particular machine and also reduce instances of catastrophic failure, such as total braking loss.

Systems and methods consistent with certain embodiments may receive command values related to commands sent to a component of a machine during a particular event, such as a braking event, acceleration event, turning event, etc. By analyzing these command values with respect to historical command values previously sent to the component of the machine and/or to corresponding components of other machines in a fleet during corresponding events, systems and methods consistent with certain embodiments may determine if and when the machine may require maintenance.

It will be apparent to those skilled in the art that various modifications and variations can be made to the disclosed performance analysis system. Other embodiments will be apparent to those skilled in the art from consideration of the specification and practice of the disclosed performance analysis system. It is intended that the specification and examples be considered as exemplary only, with a true scope being indicated by the following claims and their equivalents.

What is claimed is:

1. A computer-implemented method for analyzing machine performance comprising:

identifying an event for a machine that includes a desired output parameter value;

sending a command to a component of the machine, the command having a command value determined based on the desired output parameter value, one or more machine state parameter values, and a feedback control loop; and determining that the machine requires maintenance by comparing the command value to one or more historical command values each determined based on a historical desired output parameter value and one or more historical machine state parameter values, the historical desired output parameter value and the one or more historical machine state parameter values each corresponding to the desired output parameter value and the one or more machine state parameter values.

2. The computer-implemented method according to claim 1, wherein the event is a braking event and the desired output parameter value is a desired deceleration value, the computer-implemented method further including:

sending a braking command to a braking mechanism of the machine, the braking command having a braking command value determined based on the desired deceleration value, a velocity value, an elevation value, a payload value, and the feedback control loop; and determining that the machine requires maintenance by comparing the braking command value to a historical braking command value determined based on a historical desired deceleration value, a historical velocity value, a historical pitch value, and a historical payload value.

3. The computer-implemented method according to claim 1, wherein the event is an acceleration event and the desired output parameter value is a desired acceleration value, the computer-implemented method further including:

sending a fuel injection command to a fuel injection mechanism of the machine, the fuel injection command having a fuel injection command value determined based on the desired acceleration value, a velocity value, an elevation value, a payload value, and the feedback control loop; and determining that the machine requires maintenance by comparing the fuel injection command value to a historical fuel injection command value determined based on a historical desired acceleration value, a historical velocity value, a historical elevation value, and a historical payload value.

4. The computer-implemented method according to claim 1, wherein determining that the machine requires maintenance includes:

determining that the command value determined based on the desired output parameter value and the one or more machine state parameter values exceeds a threshold command value.

5. The computer-implemented method according to claim 1, wherein determining that the machine requires maintenance includes:

determining a command value trend by comparing the command value to the one or more historical command values, the one or more historical command values each corresponding to a previous execution of the event by the machine; and identifying a projected machine maintenance date based on the command value trend.

6. The computer-implemented method according to claim 5, wherein determining the projected machine maintenance date includes:

generating an equation that represents the command value trend by applying one or more curve fitting algorithms to the command value and the one or more historical command values; and identifying the projected machine maintenance date as a date when the equation representing the command value trend exceeds a threshold command value.

7. The computer-implemented method according to claim 5, wherein determining the projected machine maintenance date includes:

generating an equation that represents the command value trend by applying one or more curve fitting algorithms to the command value and the one or more historical command values;

comparing a rate of change of the equation representing the command value trend to a command value trend expected rate of change; and identifying the projected machine maintenance date as a date when the rate of change of the equation representing the command value trend exceeds the command value trend expected rate of change by a threshold rate of change value.

8. A system for analyzing machine performance comprising:

one or more processors; and a memory storing instructions that, when executed, enable the one or more processors to:

identify an event for a machine that includes a desired output parameter value;

send a command to a component of the machine, the command having a command value determined based on the desired output parameter value, one or more machine state parameter values, and a feedback control loop; and determine that the machine requires maintenance by comparing the command value to one or more historical command values each determined based on a historical desired output parameter value and one or more historical machine state parameter values, the historical desired output parameter value and the one or more historical machine state parameter values each corresponding to the desired output parameter value and the one or more machine state parameter values.

9. The system according to claim 8, wherein the event is a braking event and the desired output parameter value is a desired deceleration value, the instructions further enabling the one or more processors to:

send a braking command to a braking mechanism of the machine, the braking command having a braking command value determined based on the desired deceleration value, a velocity value, an elevation value, a payload value, and the feedback control loop; and determine that the machine requires maintenance by comparing the braking command value to a historical braking command value determined based on a historical desired deceleration value, a historical velocity value, a historical elevation value, and a historical payload value.

10. The system according to claim 8, wherein the event is an acceleration event and the desired output parameter value is a desired acceleration value, the instructions further enabling the one or more processors to:

send a fuel injection command to a fuel injection mechanism of the machine, the fuel injection command having a fuel injection command value determined based on the desired acceleration value, a velocity value, an elevation value, a payload value, and the feedback control loop; and determine that the machine requires maintenance by comparing the fuel injection command value to a historical fuel injection command value determined based on a historical desired acceleration value, a historical velocity value, a historical elevation value, and a historical payload value.

11. The system according to claim 8, the instructions further enabling the one or more processors to determine that the machine requires maintenance when the command value determined based on the desired output parameter value and the one or more machine state parameter values exceeds a threshold command value.

12. The system according to claim 8, the instructions further enabling the one or more processors to:

determine a command value trend by comparing the command value to the one or more historical command values, the one or more historical command values each corresponding to a previous execution of the event by the machine; and identify a projected machine maintenance date based on the command value trend.

13. The system according to claim 12, the instructions further enabling the one or more processors to:

generate an equation that represents the command value trend by applying one or more curve fitting algorithms to the command value and the one or more historical command values; and identify the projected machine maintenance date as a date when the equation representing the command value trend exceeds a threshold command value.

14. The system according to claim 12, the instructions further enabling the one or more processors to:

generate an equation that represents the command value trend by applying one or more curve fitting algorithms to the command value and the one or more historical command values;

compare a rate of change of the equation representing the command value trend to a command value trend expected rate of change; and identify the projected machine maintenance date as a date when the rate of change of the equation representing the command value trend exceeds the command value trend expected rate of change by a threshold rate of change value.

15. The system according to claim 8, further including the machine, wherein the machine is an autonomous machine and include the one or more processors and the memory.

16. A computer-implemented method for analyzing machine performance among a plurality of machines, the computer-implemented method comprising:

identifying an event for a machine of the plurality of machines, the event including a desired output parameter value;

receiving a command value of a command sent to a component of the machine, the command value having been determined based on the desired output parameter value, one or more machine state parameter values, and a feedback control loop; and determining that the machine requires maintenance based on the command value and one or more other command values generated by one or more other machines of the plurality of machines during corresponding events for the one or more other machines, the corresponding events including the desired output parameter value.

17. The computer-implemented method according to claim 16, wherein the event for the machine and each of the corresponding events for the one or more other machines occur at substantially the same time within an autonomous machine event schedule.

18. The computer-implemented method according to claim 16, wherein the event is a braking event or an acceleration event.

19. The computer-implemented method according to claim 16, the computer-implemented method further including:

calculating a command value rate of change of the machine based on historical command values of the machine during past occurrences of the event;

calculating command value rates of change of each of the one or more other machines based on historical command values of each of the one or more other machines during past executions of each of the corresponding events; and determining that the machine requires maintenance based on a comparison of the command value rate of change of the machine with the command value rates of change of the one or more other machines.

20. The computer-implemented method according to claim 19, the computer-implemented method further including:

determining that the machine requires maintenance when the command value rate of change of the machine exceeds a mean of the command value rates of change of the one or more other machines by a threshold amount.

* * * * *

UNITED STATES PATENT AND TRADEMARK OFFICE

CERTIFICATE OF CORRECTION

PATENT NO. : 8,626,385 B2
APPLICATION NO. : 13/421057
DATED : January 7, 2014
INVENTOR(S) : James Decker Humphrey It is certified that error appears in the above-identified patent and that said Letters Patent is hereby corrected as shown below:

In the Specification

Column 14, lines 30-31, delete "($C_i$, v, θ, Φ, P)" and insert -- ($C_t$, $\mathbf{A_c}$, v, θ, Φ, P) --.

Column 15, line 35, delete "Industrial Applicability" and insert -- INDUSTRIAL APPLICABILITY --.

Signed and Sealed this
Fifteenth Day of September, 2015

Michelle K. Lee

Michelle K. Lee
*Director of the United States Patent and Trademark Office*